US009643327B2

(12) United States Patent
Stevens et al.

(10) Patent No.: US 9,643,327 B2
(45) Date of Patent: May 9, 2017

(54) WET SHAVING RAZOR

(71) Applicant: The Gillette Company, Boston, MA (US)

(72) Inventors: Christopher John Stevens, Reading (GB); Paul Leslie Warrick, Reading (GB)

(73) Assignee: The Gillette Company, Boston, MA (US)

( * ) Notice: Subject to any disclaimer, the term of this patent is extended or adjusted under 35 U.S.C. 154(b) by 303 days.

(21) Appl. No.: 13/771,993

(22) Filed: Feb. 20, 2013

(65) Prior Publication Data

US 2014/0230255 A1 Aug. 21, 2014

(51) Int. Cl.

| | |
|---|---|
| ***B26B 21/52*** | (2006.01) |
| ***B26B 21/40*** | (2006.01) |
| ***A45D 27/29*** | (2006.01) |

(52) U.S. Cl.

CPC ..... *B26B 21/521* (2013.01); *A45D 27/29* (2013.01); *B26B 21/40* (2013.01); *B26B 21/52* (2013.01); *B26B 21/527* (2013.01)

(58) Field of Classification Search

CPC ..... B26B 21/222; B26B 21/225; B26B 21/52; B26B 21/521; B26B 21/525; B26B 19/3806; B26B 19/386; B26B 21/40

USPC ..... 30/47–51, 537, 539–541, 34.1, 526–527

See application file for complete search history.

(56) References Cited

U.S. PATENT DOCUMENTS

| | | | | |
|---|---|---|---|---|
| 1,234,834 | A | 7/1917 | Warren | |
| 3,164,427 | A * | 1/1965 | Norman | 312/209 |
| 5,092,041 | A * | 3/1992 | Podolsky | B26B 21/446 30/34.2 |
| 6,928,738 | B2 * | 8/2005 | Segrea | 30/34.1 |
| 7,093,363 | B1 * | 8/2006 | Kuo | B26B 21/40 30/32 |
| 7,726,032 | B1 * | 6/2010 | Hernandez | 30/526 |
| 7,814,661 | B2 * | 10/2010 | Tomassetti | A45D 27/28 222/402.13 |
| 8,141,253 | B2 * | 3/2012 | Royle | 30/34.05 |

(Continued)

FOREIGN PATENT DOCUMENTS

| | | |
|---|---|---|
| EP | 1055383 A2 | 11/2000 |
| FR | 746077 | 5/1933 |

OTHER PUBLICATIONS

PCT International Search Report and Written Opinion for PCT/US2014/015534, dated Apr. 28, 2014.

*Primary Examiner* — Jason Daniel Prone
*Assistant Examiner* — Richard Crosby, Jr.
(74) *Attorney, Agent, or Firm* — Ronald T. Sia; Kevin C. Johnson; Steven W. Miller

(57) ABSTRACT

A combination shaving and trimming device includes a powered trimmer and a wet-shaving razor attachment adapted for mounting over the trimmer. The wet shaving razor attachment includes a connecting member for mounting over the trimmer for wet shaving using the trimmer as the handle. A grip insert is provided that removably attaches to the connecting member for wet shaving independent of the trimmer. The combination shaving and trimming device and the grip insert include alignment guides providing one way attachment of the connecting member to the trimmer as well as one way attachment of the grip insert to the connecting member.

8 Claims, 21 Drawing Sheets

(56) References Cited

U.S. PATENT DOCUMENTS

| | | | | |
|---|---|---|---|---|
| 8,424,215 | B2 * | 4/2013 | Quintiliani | B26B 21/522 15/143.1 |
| 8,510,957 | B2 * | 8/2013 | Wain | B26B 21/446 30/41 |
| 8,561,300 | B2 | 10/2013 | Rehbein et al. | |
| 8,584,292 | B1 * | 11/2013 | Djang | 15/23 |
| 8,732,964 | B2 * | 5/2014 | Fischer et al. | 30/526 |
| 2006/0156551 | A1 * | 7/2006 | Khubani | B26B 19/06 30/130 |
| 2007/0209161 | A1 * | 9/2007 | Neering | A47G 21/08 16/422 |
| 2007/0227015 | A1 * | 10/2007 | Collins | 30/526 |
| 2008/0034525 | A1 * | 2/2008 | Panfili | B44C 7/027 15/236.01 |
| 2009/0007443 | A1 * | 1/2009 | Cuocolo, Jr. | 30/526 |
| 2009/0158596 | A1 * | 6/2009 | Ouchi et al. | 30/45 |
| 2010/0037463 | A1 * | 2/2010 | Maichel et al. | 30/34.1 |
| 2010/0064520 | A1 | 3/2010 | Park et al. | |
| 2010/0299927 | A1 | 12/2010 | Fischer et al. | |
| 2011/0308087 | A1 * | 12/2011 | Rehbein et al. | 30/34.1 |

* cited by examiner

FIG. 10a (PRIOR ART)
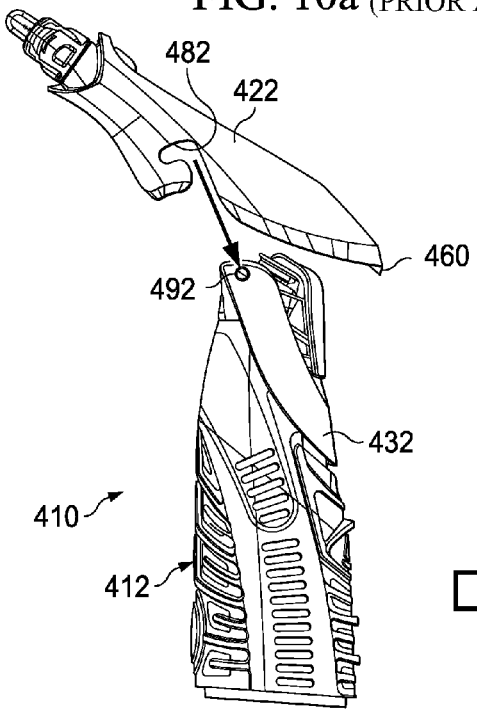
FIG. 10b (PRIOR ART)
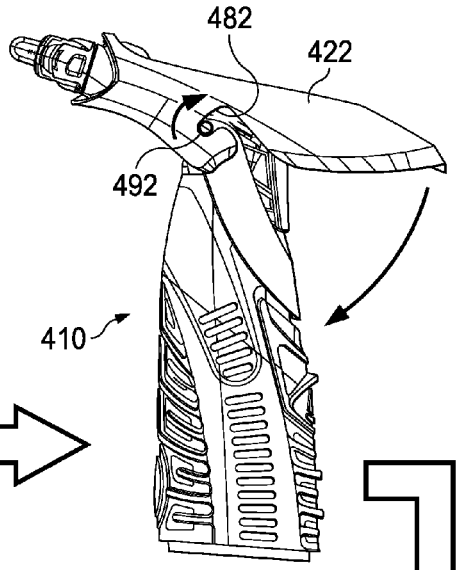
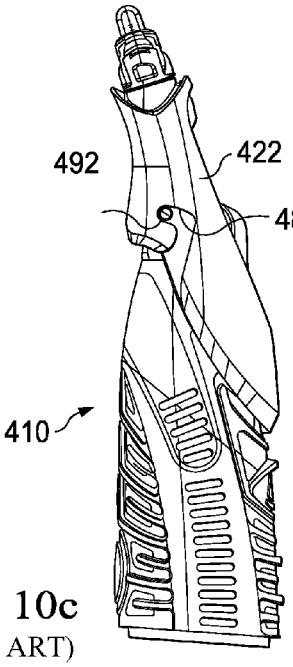
FIG. 10c
(PRIOR ART)

WET SHAVING RAZOR

FIELD OF THE INVENTION

The invention relates to a wet shaving razor for a combination shaving and trimming device. Particularly, the invention relates to a wet shaving razor attachment including a connecting member that can attach to a powered trimmer for use during wet shaving or serve as a handle that is conveniently gripped and maneuvered for wet shaving independent of the trimmer.

BACKGROUND OF THE INVENTION

Most consumers find that dealing with multiple tools like a razor, scissors and an electric trimmer every time you want to change the look of your facial hair can be a real hassle. Grooming devices providing both shaving and trimming are known in the art; however, such devices are often bulky and can be difficult to use. For instance, grooming devices having both electric trimming blades and wet shaving blades located on the same end of the device as disclosed in U.S. Pat. No. 7,536,787 can pose an obstructed view. For instance, the wet shaving blade may obstruct the user's view as he uses the trimmer to trim side burns, mustache, or other facial hair. A shaving and trimming device was developed having a removable wet shaving wet shaving attachment including a connecting member having one end attaching to a wet shaving razor blade cartridge and another end attaching to the trimmer.

The connecting member between trimmer and wet shaving razor blade cartridge has to fulfill several requirements. The structure has to be firm and secure during wet-shaving usage to transfer all forces and movements of the trimmer handle onto the wet shaving cartridge. Specifically, unintended disengaging of the attachment has to be avoided in order to prevent injuries. The structure has to be easily attachable and removable for the consumer to switch between wet-shaving and trimming applications. In addition, the structure has to be able to withstand an impact force in case the trimmer with wet-shaving attachment is dropped during use in order to prevent damage to the connecting member and corresponding cartridge. In some combinations, the wet shaving and grooming device is designed such that the structure transfers vibrations generated from the trimmer handle into the wet shaving attachment. This requires a firm fit without any play or clearance between the parts that would result in loss of amplitude and possibly produce a rattling noise.

Although the combination shaving and trimming device previously described offers many conveniences, consumers may prefer to shave using the wet shaving razor attachment alone without attaching it to the trimmer. In addition the small size of the wet shaving razor attachment takes up ideal space making it ideal for travel. Although the connecting member is designed to provide a robust connection to the trimmer, it also has a minimum weight so that the combination trimmer and wet shaving attachment is not over burdensome. As a result, the wet shaving razor attachment may be too light and difficult to grip to provide a comfortable shave.

There is a need for a combination shaving and trimming device having a wet shaving attachment including a connecting member that is easily attachable and removable for the consumer. In addition there is a need for a wet shaving attachment including a connecting member that can serve as a handle that can be easily gripped and maneuvered by the consumer for shaving with the wet shaving razor attachment alone.

SUMMARY OF THE INVENTION

A combination shaving and trimming device is provided comprising a battery operated trimmer and wet-shaving razor attachment removably connected to the trimmer via a releasable locking mechanism. The wet shaving razor attachment comprises a connecting member having a forward end, an aft end, and opposing sides therebetween. A grip insert is provided that removably attaches to the connecting member for wet shaving independent of the trimmer. An overhanging shoulder is disposed proximate the forward end of the connecting member and at least one hook is disposed at the aft end. The grip insert has a forward end, an aft end, and opposing sides therebetween. The grip insert includes a slot disposed in the aft end, wherein the slot releasably attaches to the at least one hook disposed at the aft end of the connecting member and the forward end of the grip insert releasably attaches to the overhanging shoulder of the connecting member. A razor cartridge is attached to the forward end of the connecting member.

In one embodiment, the connecting member further comprises alignment guides disposed on the opposing sides of the connecting member proximate the forward end. The grip insert further comprises alignment guides disposed on the opposing sides, proximate the forward end. The alignment guides disposed on the opposing sides of the grip insert releasably attach to the alignment guides disposed on the opposing sides of the connecting member. The alignment guides disposed on opposing sides of the connecting member comprise alignment grooves and the alignment guides on opposing sides of the grip insert comprise alignment members.

In one embodiment, the wet shaving razor attachment and grip insert are provided in a kit.

BRIEF DESCRIPTION OF THE DRAWINGS

FIGS. 10*a*-10*c* are perspective views of the combination shaving and trimming device illustrating the installation of the wet shaving razor attachment utilizing the alignment guides and alignment members according to the present invention.

DETAILED DESCRIPTION OF THE INVENTION

Figure 1A:
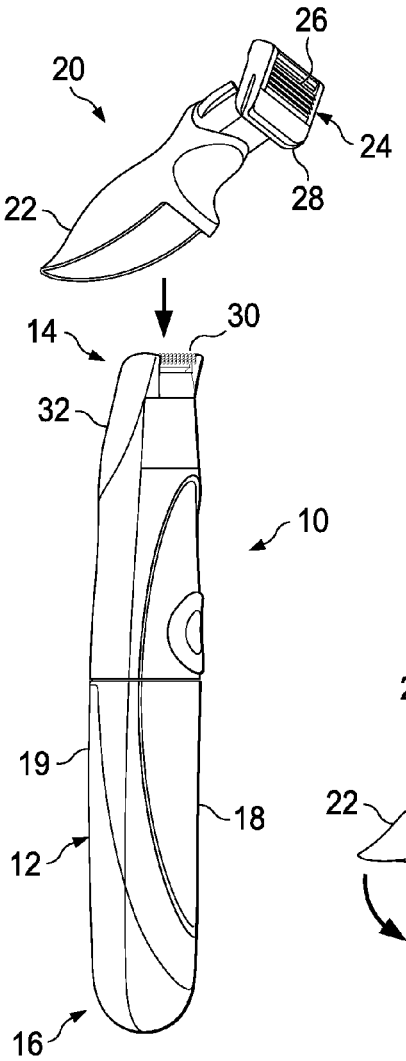
FIG. 1a (PRIOR ART)
FIGS. 1*a*-1*c* are perspective views of the combination shaving and trimming device illustrating the installation of the wet shaving razor attachment.
Figure 1B:
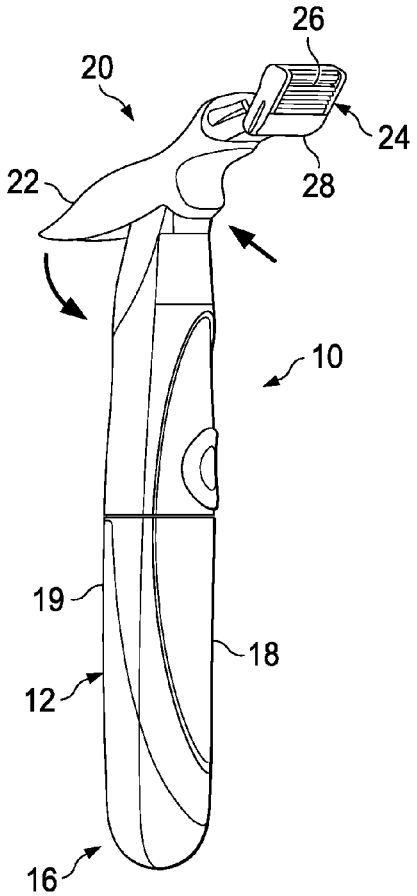
FIG. 1b (PRIOR ART)
Figure 1C:
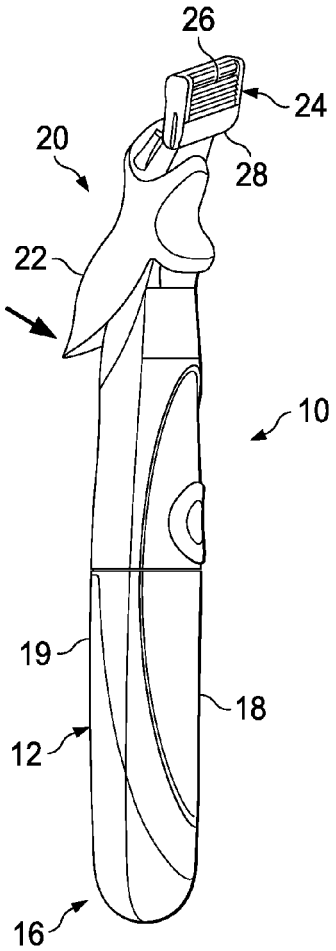
FIG. 1c (PRIOR ART)

FIGS. 1*a*-1*c* show a combination shaving and trimming device 10. The device 10 includes a handle 12, a powered trimmer 30, and a wet-shaving razor attachment 20 removably connected to the trimmer 30. The handle 12 has an upper end 14 and lower end 16, a front side 18 and a back side 19. The trimmer 30 is located at or near upper end 14 on the front side 18 and is configured for moving at least one trimming blade, which may be serrated, and wherein this trimming blade is disposed within the trimmer 30. In certain embodiments, there may be more than one trimming blade disposed in a stacked position wherein at least one reciprocates against the other to effect a trimming or cutting action on hair that is placed adjacent to a cutting edge of the one or more trimming blades. A trimmer housing 32 is disposed adjacent the upper end 14 near the trimmer 30.

The wet-shaving razor attachment 20 includes connecting member 22 and razor cartridge 24. The connecting member 22 is adapted for mounting over the trimmer 30 onto the handle 12. The razor cartridge 24 engagably mates with the connecting member 22. In the embodiment of FIG. 1*a*-*c*, the razor cartridge 24 is removably attached to the connecting member 22. The razor cartridge 24 includes one or more blades 26 mounted within a housing 28 of the cartridge 24. The device 10 is configured to operate as a trimming device, as shown in FIG. 1*a*, with the wet shaving razor attachment 20 completely removed, or as a wet-shaving device with the wet shaving attachment 20 removably attached to upper end 14. FIGS. 1*b* and 1*c* illustrate the progression of the assembly of the wet shaving razor attachment 20 to the handle 12. The combination shaving and trimming device 10 can function as a powered wet-shaving device by activating the trimmer motor while the wet shaving razor attachment 20 is assembled on the handle 12 such that the resulting vibration from the trimmer motor translates vibration to the razor attachment 20.

In another embodiment (not shown), the wet-shaving razor attachment 20 includes an ejection mechanism for removably attaching the razor cartridge 24 to the connecting member 22. In yet another embodiment, the razor cartridge 24 includes one or more razor blades on a front surface and at least one blade disposed substantially perpendicular to the front surface. The ejection mechanism and the razor cartridge 24 is disclosed in U.S. Pat. No. 7,669,335 to Vincent Walker and assigned to The Gillette Company.

Figure 9:
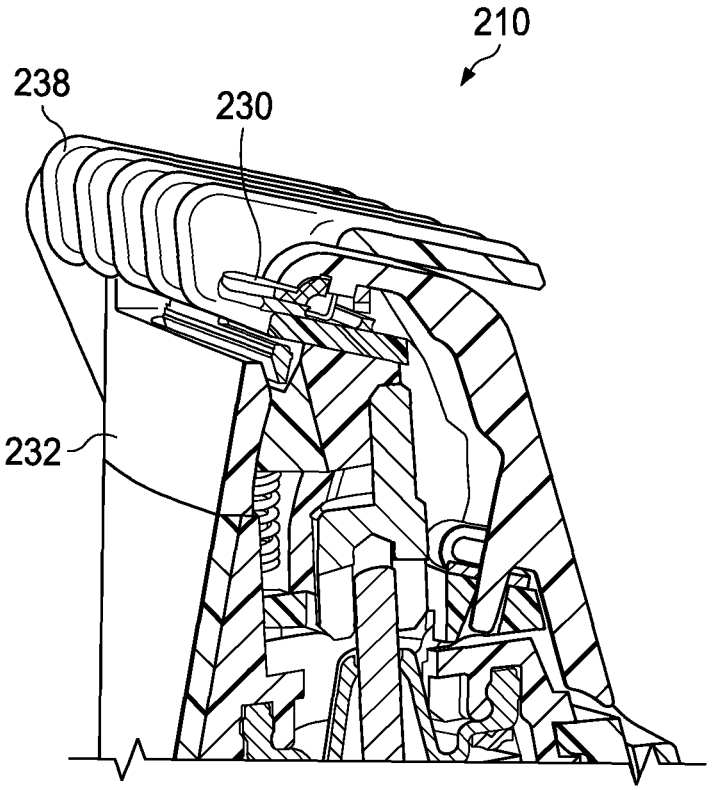
FIG. 9 (PRIOR ART)
FIG. 9 shows a partial cross-sectional view of a combination wet shaving and trimming device with a trimmer comb attached.

In another embodiment, comb attachments for trimming hair to a desired length may be assembled to the trimming device 210 when the wet shaving razor attachment is completely removed. As shown in FIG. 9, comb attachment 238 can be configured to attach to the trimmer housing 232 using some or all of the same connecting features used for the wet shaving razor attachment.

In the embodiment shown in FIGS. 2*a*-2*d*, the trimming device 10 includes a trimmer housing 32 comprising at least one overhanging edge 34 disposed on the front side 18 of the trimmer 30 that interfaces with the connecting member 22 of the wet shaving razor attachment 20. In an alternate embodiment, the trimmer housing 32 can include two spaced apart overhanging edges 34 disposed on the front side 18 on opposite sides of the trimmer 30 which is to the left and right of the trimmer 30. In another embodiment described more fully below, the trimmer housing 32 can include two spaced apart alignment guides disposed proximate the powered trimmer 30 on opposite sides of the trimmer housing 32 providing mating, releasable attachment with alignment guides disposed on the connecting member 22 of the wet shaving razor attachment 20.

The trimming device 10 includes a spring loaded slider 40 disposed proximate the upper end 14 on the back side 19 of the handle 12 providing a releasable connection for the wet shaving razor attachment 20. The spring loaded slider 40 includes a slot 42 having a forward side 44 and an aft side 46. The forward side 44 of the slot 42 includes an overhanging lip 48 that interfaces with the connecting member 22 of the wet shaving razor attachment 20. The spring loaded slider 40 includes a spring 70 that biases linear movement of the slider 40 in forward and aft directions. In the embodiment shown in FIGS. 2*a* and 2*c*, the spring 70 is located near the forward side 44 of the slot 42. However, in alternate embodiment shown in FIG. 3 fully described below, the spring 170 is located near the aft side 146 of the slot 142.

The wet shaving razor attachment 20 comprises a connecting member 22 having a forward end 50 and an aft end 52; a front face 54 and a back face 56. The connecting member 22 includes an overhanging shoulder 58 disposed on the front face 54 proximate the forward end 50. The overhanging shoulder 58 releasably attaches to the overhanging edge 34 of the trimmer housing 32. In a alternate embodiment described more fully below, the connecting member includes alignment guides disposed on opposite sides of the connecting member that releasably mate with alignment guides disposed on the trimmer housing 32.

Figure 2A:
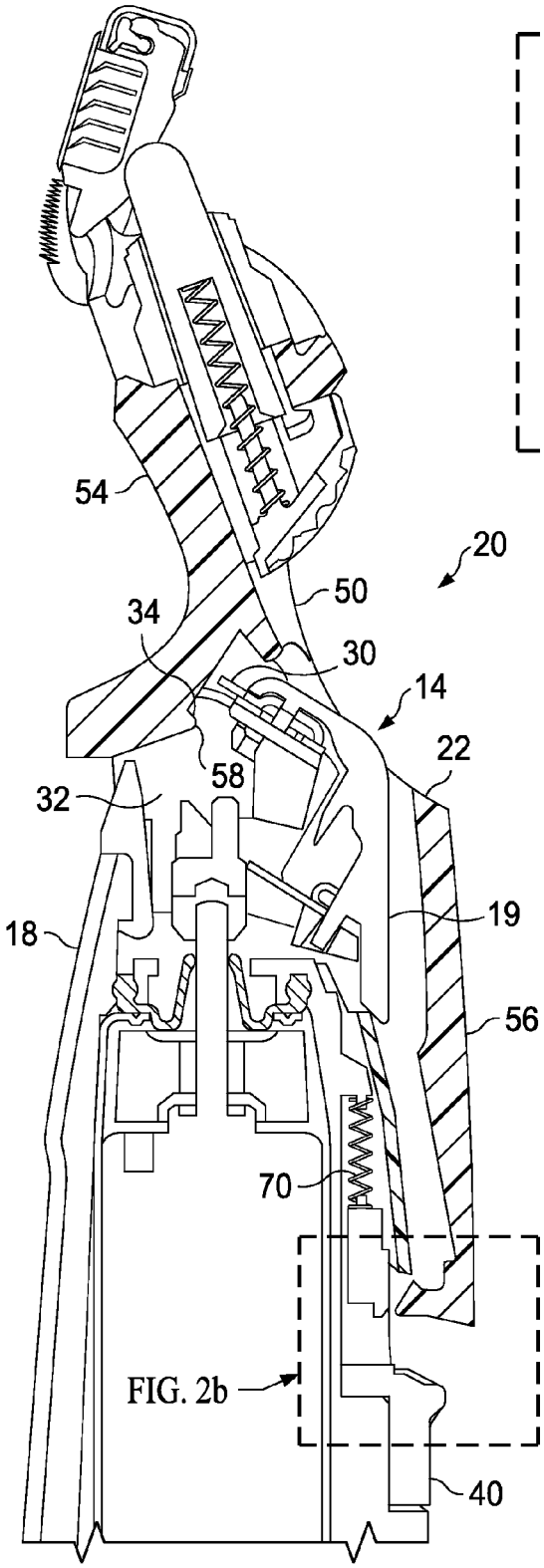
FIG. 2a (PRIOR ART)
FIGS. 2*a*-2*d* are cross section views of the combination wet shaving and trimming device showing the locking mechanism for the wet shaving razor attachment.
Figure 2B:
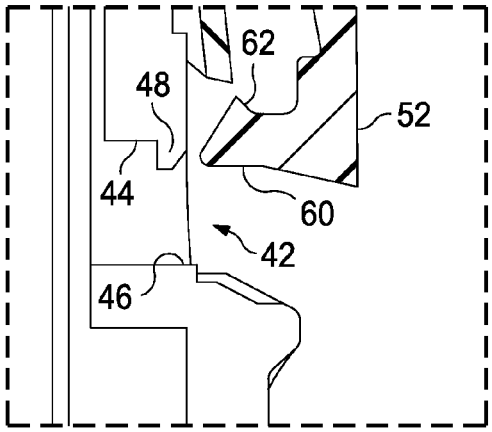
FIG. 2b (PRIOR ART)
Figure 2C:
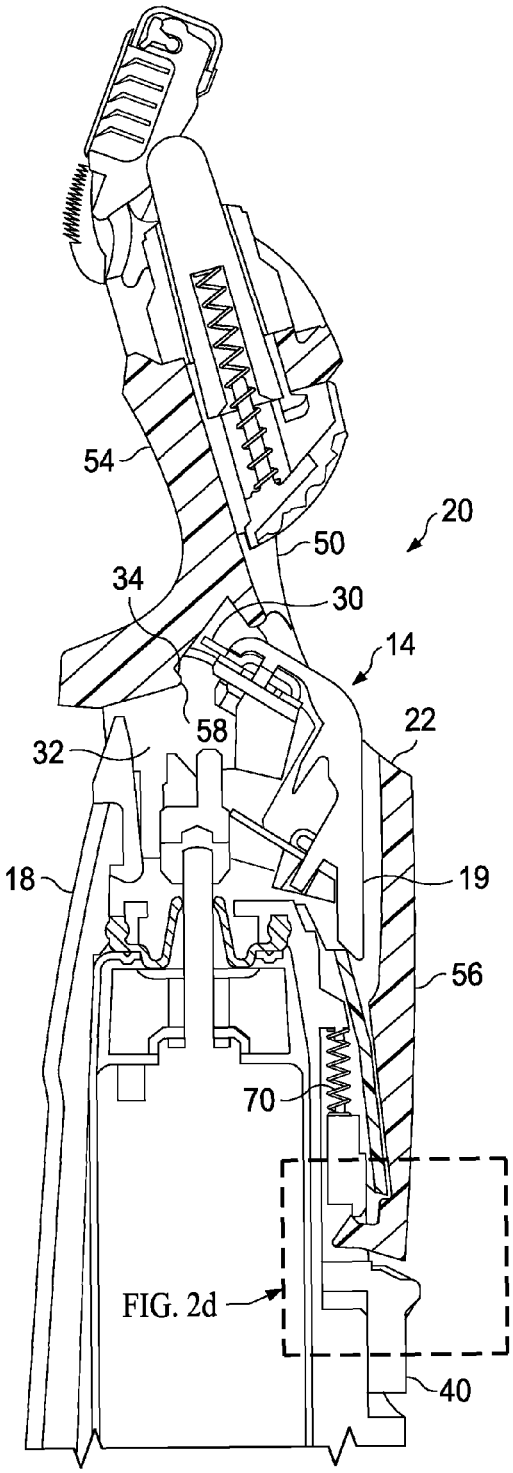
FIG. 2c (PRIOR ART)
Figure 2D:
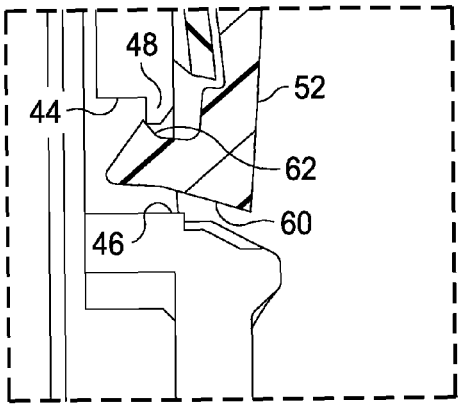
FIG. 2d (PRIOR ART)

At least one hook 60 is disposed on the front face 54 of the connecting member 22 at the aft end 52. The hook 60 includes a latching surface 62. As shown in FIGS. 2*b* and 2*d*, the hook 60 releasably attaches to the slot 42 in the spring loaded slider 40 such that the latching surface 62 abuts the overhanging lip 48 on the forward side 44 of the slot 42. An audible click is produced while attaching the hook 60 of the connecting member 22 to the overhanging lip 48 on the forward side 44 of the slot 42. In an alternate embodiment not shown, the connecting member can include two or more hooks disposed at the aft end of the connecting member.

In the embodiment shown in FIGS. 2*a*-2*d*, the latching surface 62 is angled so that the spring force produced by the spring 70 attached to the slider 40 pulls the connecting member 22 into a close fitting relationship with the handle 12. The combination of the angled configuration of the latching surface 62 and spring loaded slider 40 also allows the connecting member 22 to disengage under excessive force such as a sudden impact produced as a result of dropping the device 10. Allowing the connecting member 22 to separate from the handle 12 under such force can save the connecting member 22 from breaking in case the device is accidently dropped during use.

Figure 3:
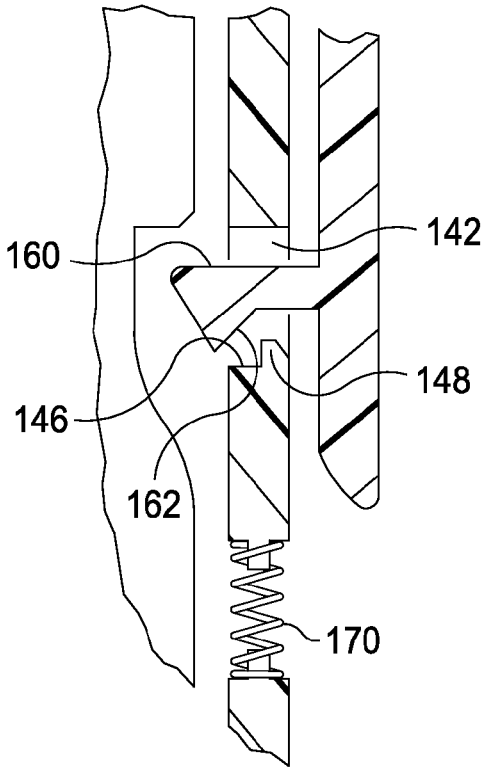
FIG. 3 (PRIOR ART)
FIG. 3 is a cross section of an alternate embodiment of the locking mechanism shown in FIGS. 2*a*-2*d*.

In the alternate embodiment shown in FIG. 3 where the spring 170 is located near the aft side 146 of the slot 142, the hook 160 and corresponding latching surface 162 are oriented toward the aft side 146 of the slot 142. In this embodiment, the aft side 146 of the slot 142 includes the overhanging lip 148 which interfaces with latching surface 162 on hook 160.

Figure 4A:
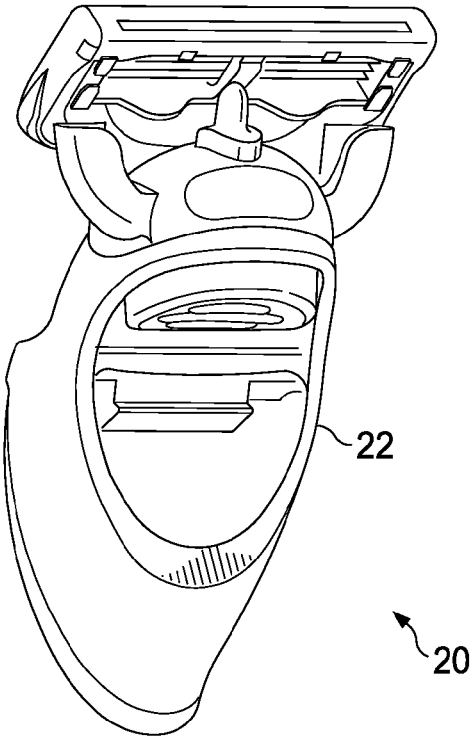
FIG. 4a (PRIOR ART)
FIGS. 4*a*-4*c* are perspective views of the wet shaving razor attachment.
Figure 4B:
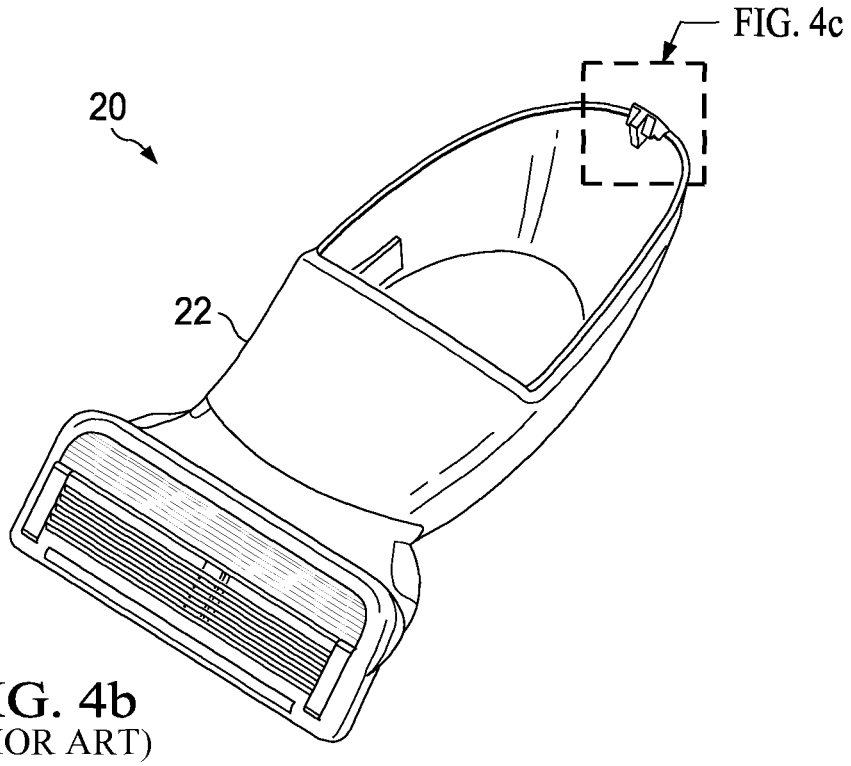
FIG. 4b (PRIOR ART)
Figure 4C:
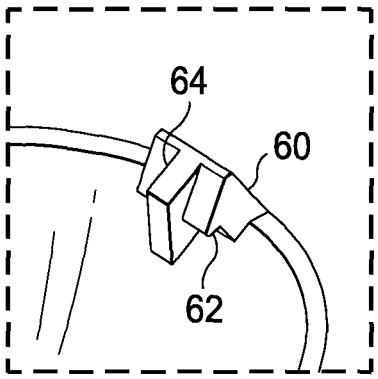
FIG. 4c (PRIOR ART)
Figure 5:
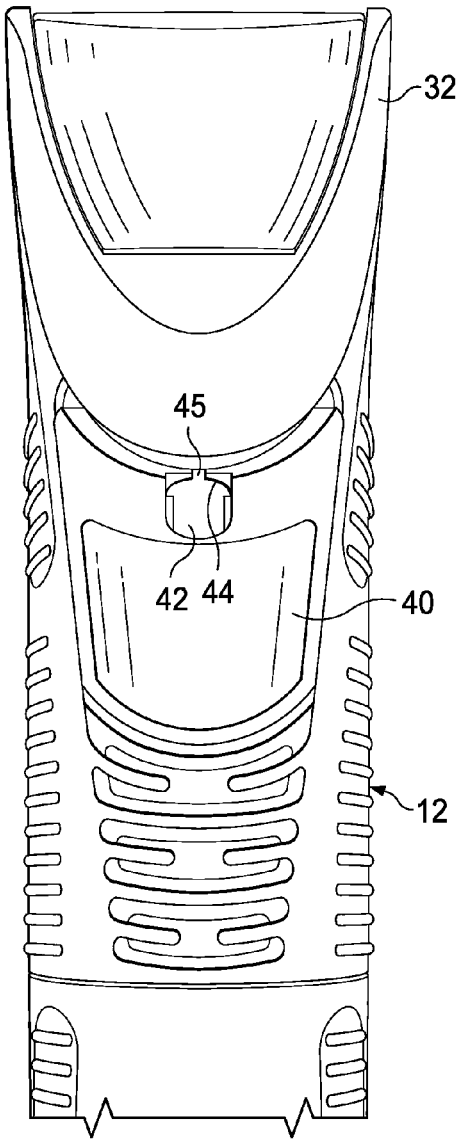
FIG. 5 (PRIOR ART)
FIG. 5 is a top view of a trimmer embodiment according to the present invention.
Figure 6A:
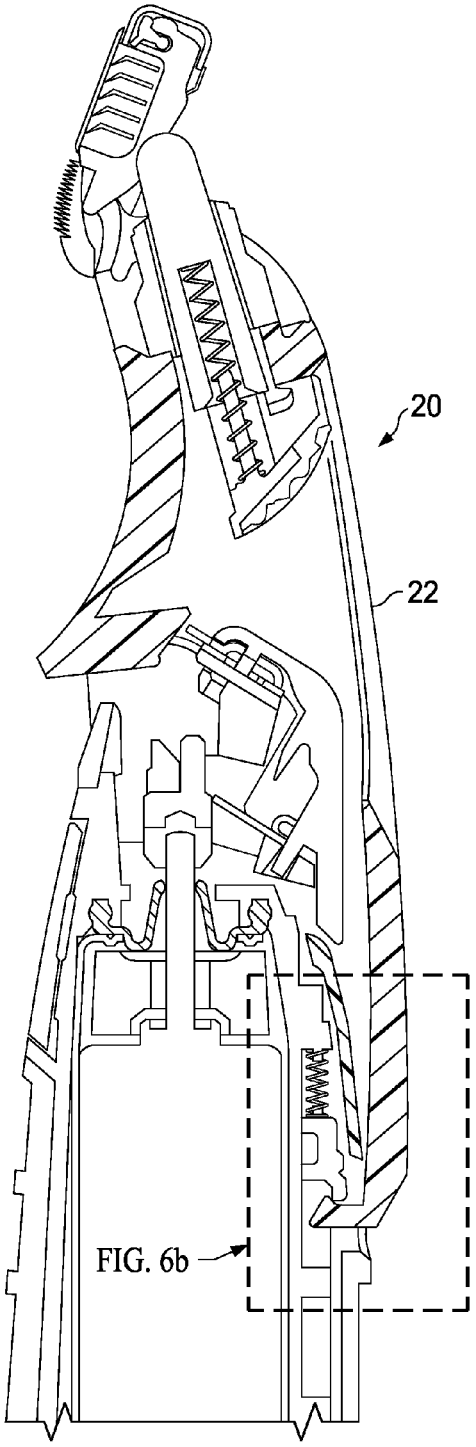
FIG. 6a (PRIOR ART)
FIGS. 6*a* and 6*b* are cross section views of a locking mechanism for the trimmer embodiment shown in FIG. 5.
Figure 6B:
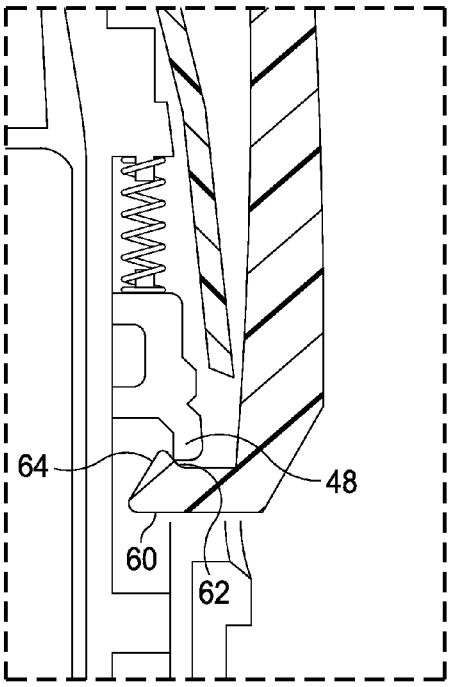
FIG. 6b (PRIOR ART)

In one embodiment shown in FIGS. 4*a*-4*c*, the hook 60 on the connecting member 22 includes a rib 64 that limits movement of the connecting member 22 during normal use (i.e. shaving, removing a cartridge from the connecting member, etc.). The rib 64 is disposed in the middle of the forward face of the hook 60. For this embodiment, the slot 42 in spring loaded slider 40 shown in FIG. 5 includes a channel 45 in the forward side 44 of the slot 42 to accommodate the rib 64. The channel 45 is oriented perpendicular to the forward side 44 of the slot 42. FIGS. 6*a* and 6*b* show the wet shaving razor attachment 20 including the connecting member 22 and hook 60 with the rib 64 releasably attached to the slot 42 and channel 45 shown in FIG. 5.

In an alternate embodiment shown in FIG. 7*a*-7*d*, the connecting member 222 can be configured to provide the biased releasable connection between the connecting member 222 and the handle 212. For this embodiment, the handle 212 is configured with the slot 242 disposed directly in the back side 219 of the handle 212 proximate the upper end 214 without a spring loaded slider. Similar to the slider configuration previously described, the slot 242 in the handle 212 includes a forward side 244 and an aft side 246. The forward side of the slot includes an overhanging lip 248. The connecting member 222 includes a front face 254 and a back face 256 and a forward end 250 and a resilient flexible aft end 252. An overhanging shoulder 258 is disposed on the front face 254 proximate the forward end 250. The overhanging shoulder 258 releasably attaches to at least one overhanging edge 234 of the trimmer housing 232 on the front side 218 of the handle 212. Preferably, the overhanging shoulder 258 releasably attaches to two overhanging edges 234 of the trimmer housing 232 disposed on opposite sides of the trimmer 230. A hook 260 is disposed on the front face 254 at the resilient flexible aft end 252. The hook 260 includes a forward facing latching surface 262, wherein the hook 260 releasably attaches to the slot 242 in the back side 219 of the handle 212. The latching surface 262 is biased against the overhanging lip 248 on the forward side 244 of the slot 242 by the resilient flexible aft end 252.

Figure 7A:
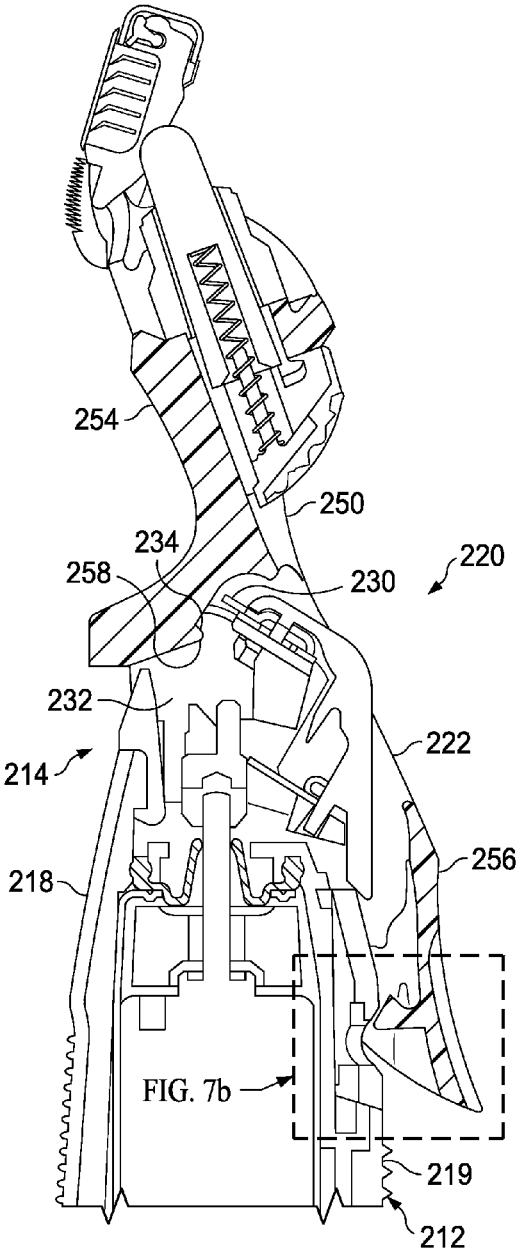
FIG. 7a (PRIOR ART)
FIGS. 7*a*-7*d* are cross sections of alternate embodiments of the wet shaving razor attachment.
Figure 7B:
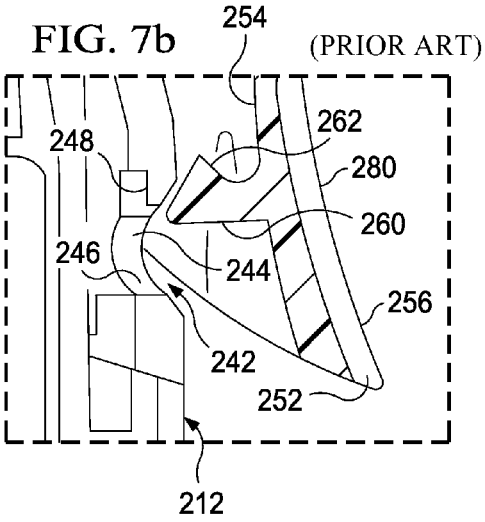
FIG. 7b (PRIOR ART)
Figure 7C:
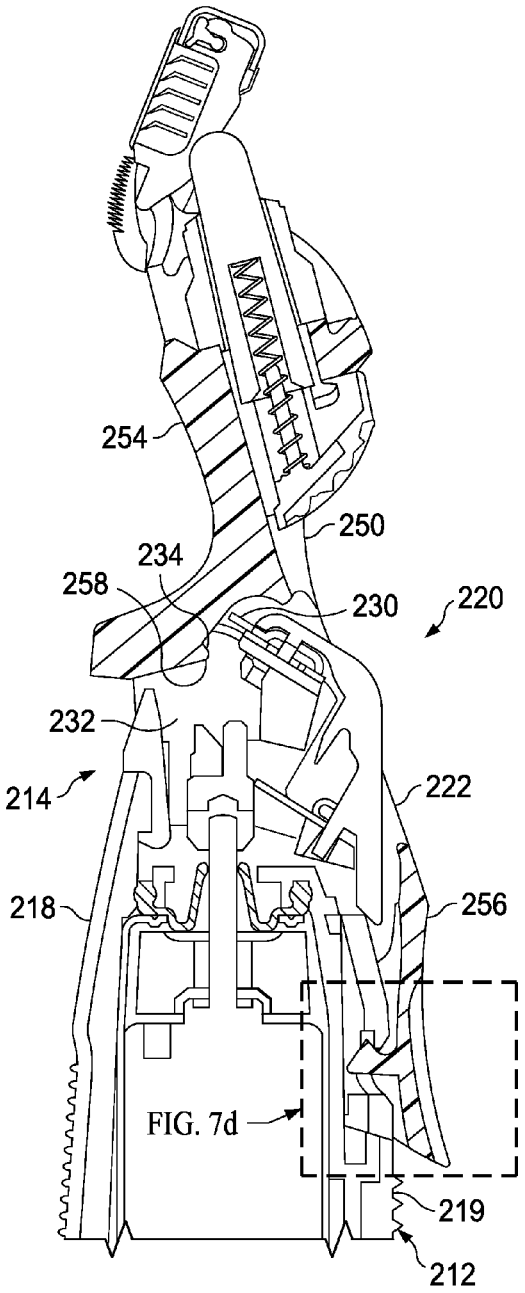
FIG. 7c (PRIOR ART)
Figure 7D:
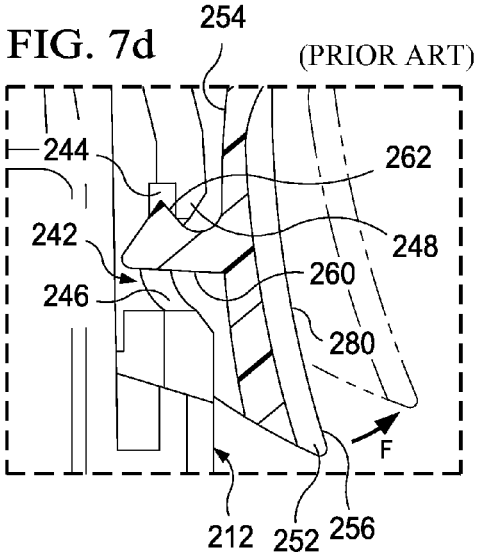
FIG. 7d (PRIOR ART)

For this embodiment, the resilient aft end 252 of the connecting member 222 can include molded elastic element 280 attached to the back face 256 of the connecting member 222 as shown in FIG. 7*a*-7*d*. The molded elastic element 280 provides resilient flexibility necessary for releasable attachment between the connecting member 222 and the handle 212. As shown in FIG. 7*d*, the connecting member 222 is removed by applying force F to the resilient aft end 252 of the connecting member 222.

Figure 8A:
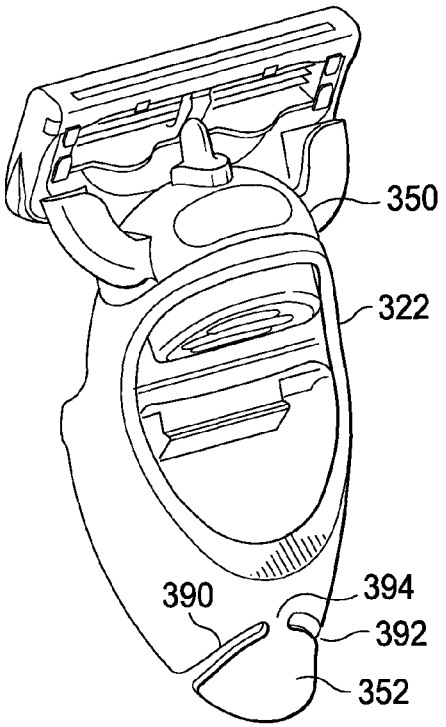
FIG. 8a (PRIOR ART)
FIGS. 8*a* and 8*b* are perspective views of alternate embodiments of the wet shaving razor attachment.
Figure 8B:
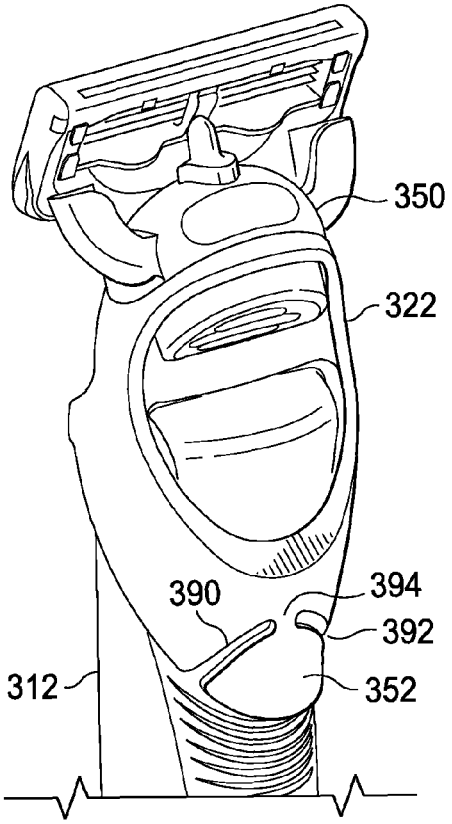
FIG. 8b (PRIOR ART)

In an alternate embodiment shown in FIGS. 8*a* and 8*b*, the connecting member 322 can be composed of a hard plastic and the resilient aft end 352 can be configured to be resiliently flexible. In the embodiment shown in FIG. 8*a*, the aft end 352 is partially separated from the forward end 350 by discontinuous slots 390, 392 in opposing sides of the connecting member 322 forming an integral strip 394 of hard plastic connecting the aft end 352 to the forward end 354 of the connecting member 322. The integral strip 394 of hard plastic forms a resilient flexible aft end 352 enabling the aft end 352 and corresponding hook (not shown) to deflect during removable attachment of the connecting member 322 to the handle 312 as shown in FIG. 8*b*.

In order to ensure correct assembly of the wet shaving razor attachment 20 to the trimmer 10, the combination shaving and trimming device can include features providing one way attachment of the wet shaving razor attachment 20 to the trimmer 10. FIGS. 10*a*-10*c* illustrate the progression of the assembly of the wet shaving razor attachment 422 to the trimming device 410 including alignment guides providing one way attachment. Such features can include alignment guides disposed on both the trimming device 410 and the connecting member 422 of the wet shaving razor attachment.

Figure 11:
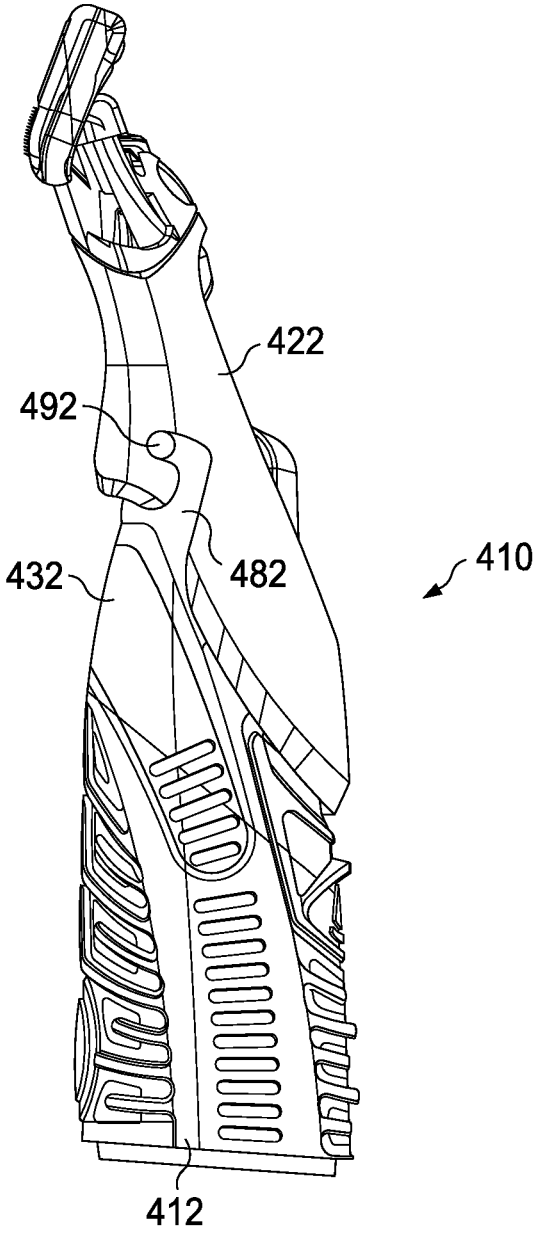
FIG. 11 (PRIOR ART)
FIG. 11 is a side view of the combination shaving and trimming device including the alignment guides and alignment members according to the present invention.

For the embodiment shown in FIGS. 10*a*-10*c*, the trimmer housing includes alignment members 492 disposed on the trimmer housing 432 proximate the powered trimmer blade on opposite sides of the trimmer housing 432. For this embodiment the connecting member 422 includes alignment grooves 482 disposed on opposite sides of the connecting member 422 proximate the forward end of the connecting member 422. The alignment grooves 482 mate with the alignment members 492. As shown in FIG. 11 the alignment members 492 can include pins extending from the trimmer housing 432 and the alignment grooves 482 can include slots in opposing sides of the connecting member 422. For the embodiment shown in FIGS. 10*a*-10*c* and FIG. 11, the alignment grooves 482 in the connecting member 422 are L-shaped to provide one way attachment of the connecting member 422 to the trimmer housing 432 and promote rotation of the connecting member 422 about the pins 492 in order to bring the hook 460 on the aft end of the connecting member 422 into contact with the slot in the backside of the trimmer handle 412.

Figure 12A:
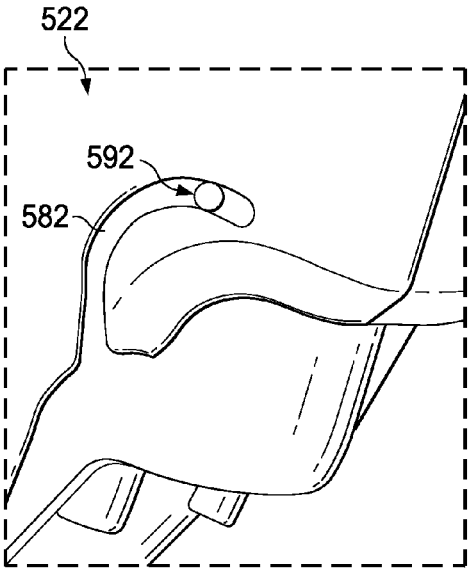
FIG. 12a (PRIOR ART)
FIG. 12*a* is side view of the connecting member showing the visible portion of a stepped slot and tiered pin at assembly.
Figure 12B:
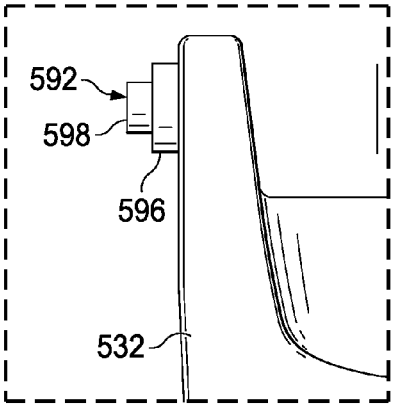
FIG. 12b (PRIOR ART)
FIG. 12*b* is a cross sectional view of the tiered pin interfacing with the stepped slot shown in FIG. 12*a*.
Figure 12C:
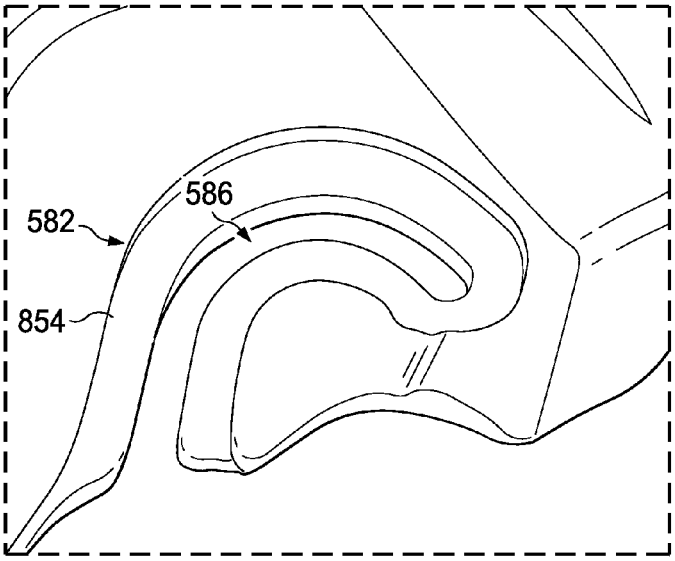
FIG. 12c (PRIOR ART)
FIG. 12*c* is a side view of the inside surface of the connecting member showing the stepped surface of the stepped slot shown in FIG. 12*a*.

In an alternate embodiment shown in FIG. 12*a*-12*c*, the alignment members include tiered pins and the alignment grooves include stepped grooves in order to minimize the impact of the alignment guides on the aesthetics of the combination shaving and trimming device. The tiered pins 592 include a base 596 having a first diameter joined to the trimmer housing 532 and tip 598 extending away from the trimmer housing 532 having a second diameter wherein the first diameter is larger than the second diameter. For this embodiment, the alignment grooves 582 in the connecting member 522 comprise a compound groove 582 on the inside surface of the connecting member 522 forming a first channel 584 having a first width on the inside surface of the connecting member 522 and a second channel 586 inside of the first channel 584 having a second width that is smaller than the first width. At assembly the first channel 584 receives the base 596 of the tiered pin 592 and the second channel 586 receives the tip 598 of the tiered pin 592. The diameter of the pin 592 at the base 596 is sized to provide good mechanical resistance and a good guiding surface and a step is created in order to reduce the diameter of the tip portion 598 of the pin. As a result, only the second channel portion 586 of the alignment grove 582 on the connecting member 522 and tip portion 598 of the tier shaped pin 592 on the trimmer housing 532 are visible upon assembly. In another embodiment, a translucent material may cover the second channel portion 586 thereby closing the second channel portion such that the tip portion 598 of the tier shaped pin 592 is visible but not exposed at assembly.

Figure 13:
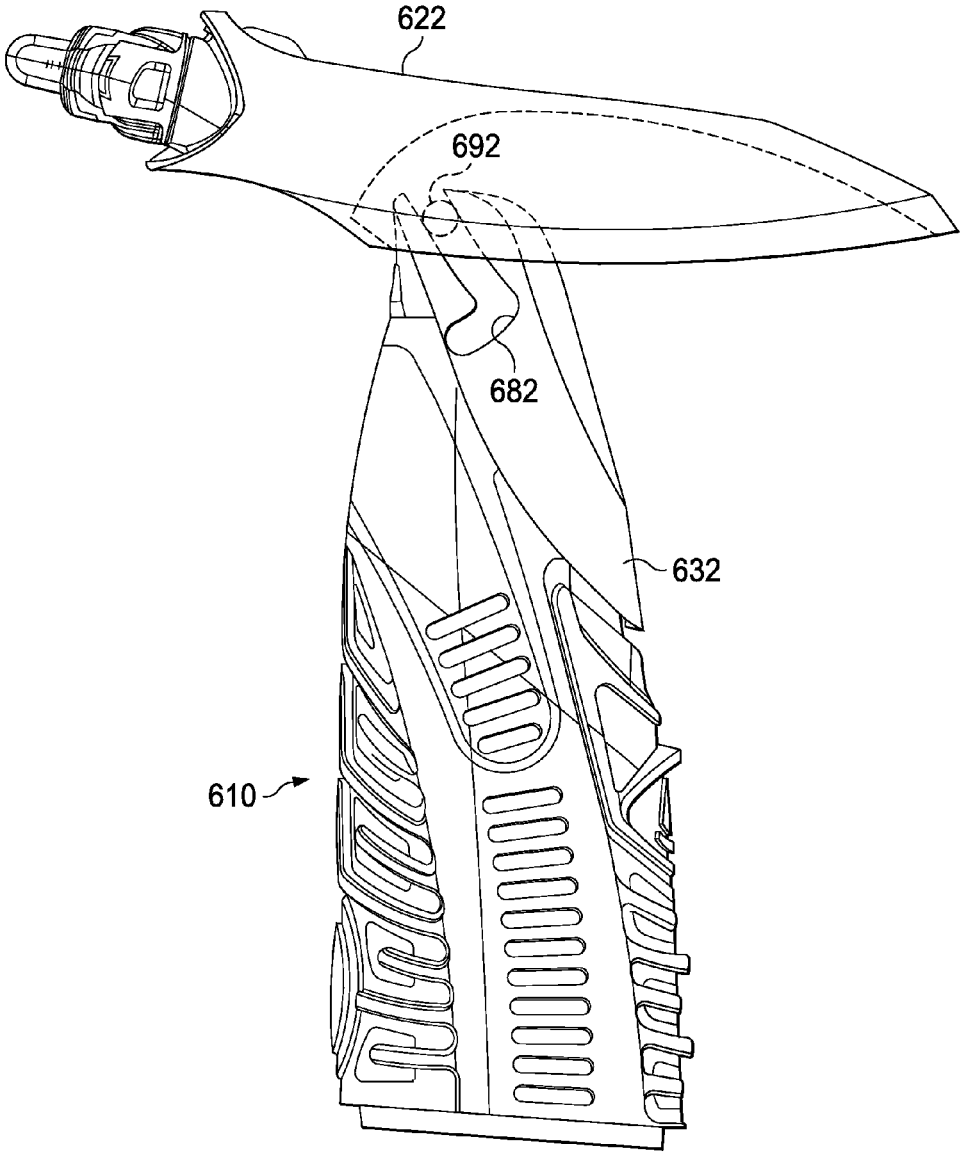
FIG. 13 (PRIOR ART)
FIG. 13 is side view of a connecting member attaching to a trimmer housing where alignment members are disposed on the inside surface of the connecting member and alignment guides comprising grooves are disposed on the external surface of the trimmer housing.

In another embodiment shown in FIG. 13, the trimming device 610 includes alignment guides on the trimmer housing 632 comprising alignment grooves 682 and the alignment guides on the connecting member 622 comprising alignment members 692. For this embodiment the alignment members 692 include pins disposed on the inside surface of the connecting member 622 on opposing sides of the connecting member 622. The alignment grooves 682 include channels proximate the powered trimmer blade on opposing sides of the trimmer housing 632.

Figures 14A, 14B, 14C:
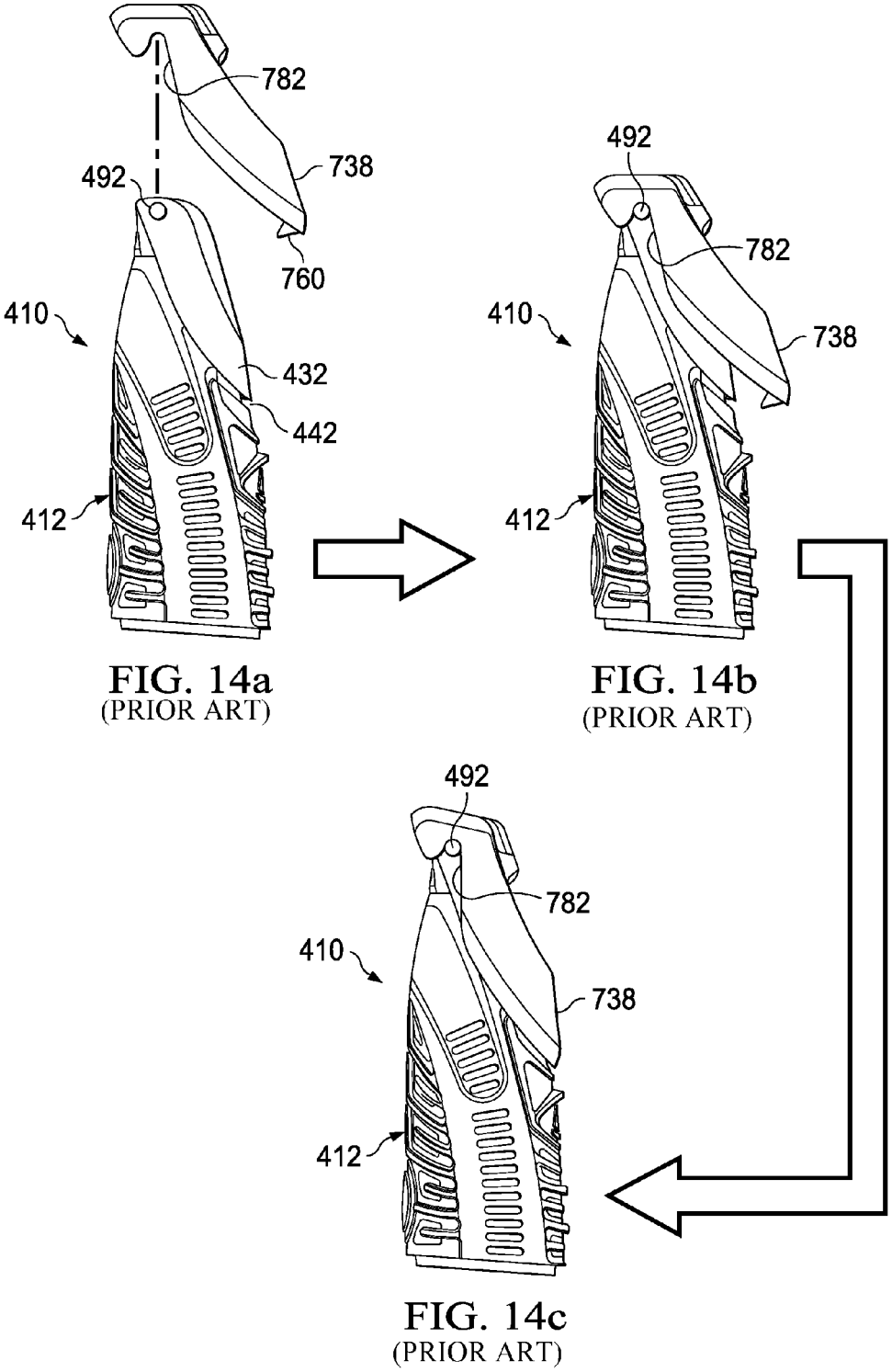
FIG. 14a (PRIOR ART)
FIG. 14b (PRIOR ART)
FIG. 14c (PRIOR ART)
FIGS. 14*a*-14*c* are side views of the trimmer and comb attachment illustrating the installation of the comb attachment utilizing the alignment guides and alignment members according to the present invention.

The comb attachments previously described and shown in FIG. 9 for trimming hair to a desired length may be assembled to the trimming device 410 using alignment guides and alignment members previously described. As shown in FIGS. 14*a*-14*c*, comb attachment 738 can be configured to attach to the trimmer housing 432 of the trimming device 410 using some or all of the same connecting features used for the wet shaving razor attachment. For this embodiment, the comb attachment 738 includes alignment grooves 782 disposed on opposite sides of the comb attachment 738 proximate the forward end of the comb attachment 738. The alignment grooves 782 mate with the alignment members 492 on the trimmer housing 432. As shown in FIG. 14*a*, the alignment members 492 can include pins extending from the trimmer housing 432 and the alignment grooves 782 can include slots in opposing sides of the comb attachment 738. Similar to the connecting members previously described and shown in FIGS. 10*a*-10*c*, the comb attachment 738 shown in FIGS. 14*a*-14*c* include L-shaped alignment grooves 782 providing one way attachment of the comb attachment 738 to the trimmer housing 432 and promoting rotation of the comb attachment 738 about the pins 492 in order to bring the hook 760 on the aft end of the comb attachment 738 into contact with the slot 442 in the backside of the trimmer handle 412.

Figure 15A:
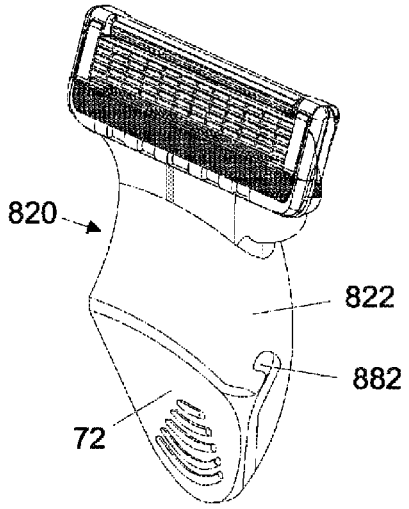
FIG. 15*a* is a perspective view of the wet shaving razor attachment including a grip insert according to the present invention.
Figure 15B:
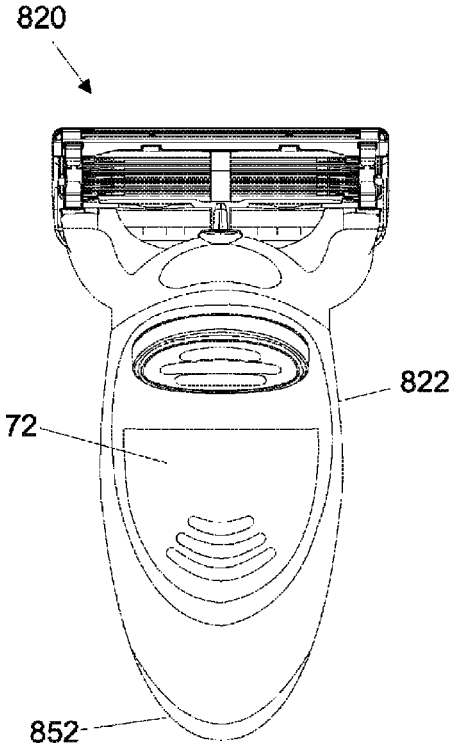
FIG. 15*b* is a top view of the wet shaving razor attachment including a grip insert shown in FIG. 15*a*.
Figure 15C:
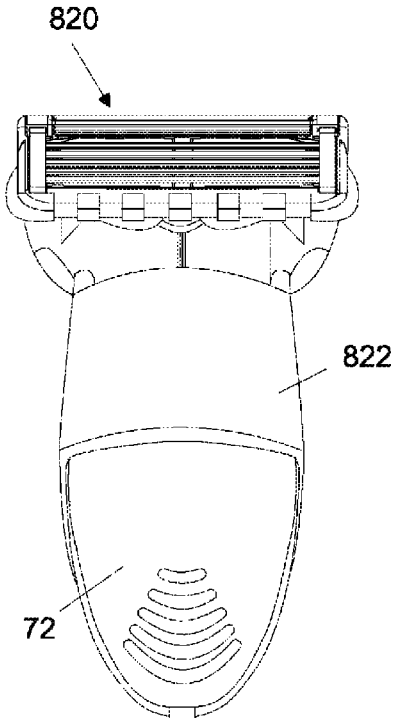
FIG. 15*c* is a bottom view of the wet shaving razor attachment including a grip insert shown in FIG. 15*a*.
Figure 16C:
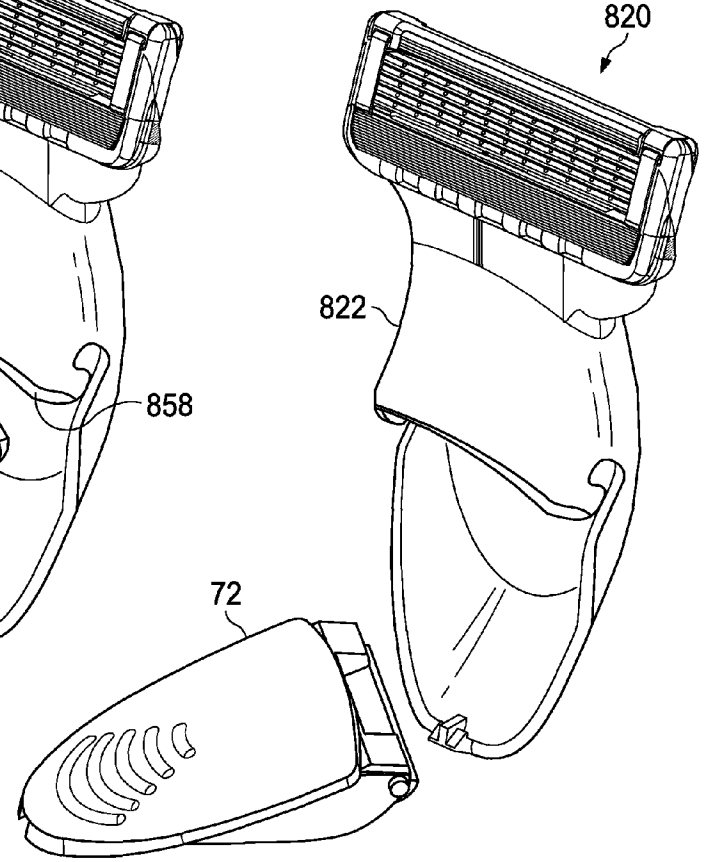
FIGS. 16*a*-16*c* are perspective views of the wet shaving razor attachment illustrating the installation of the grip insert into the connecting member of the wet shaving razor attachment.
Figure 16B:
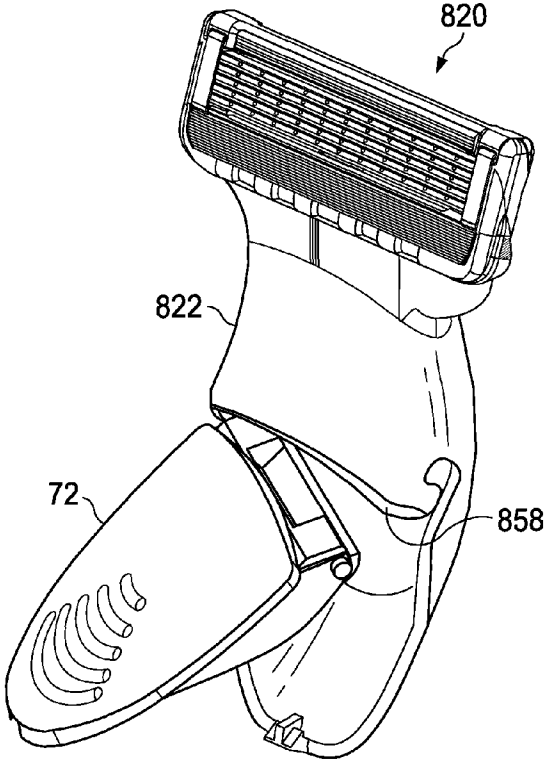
Figure 16A:
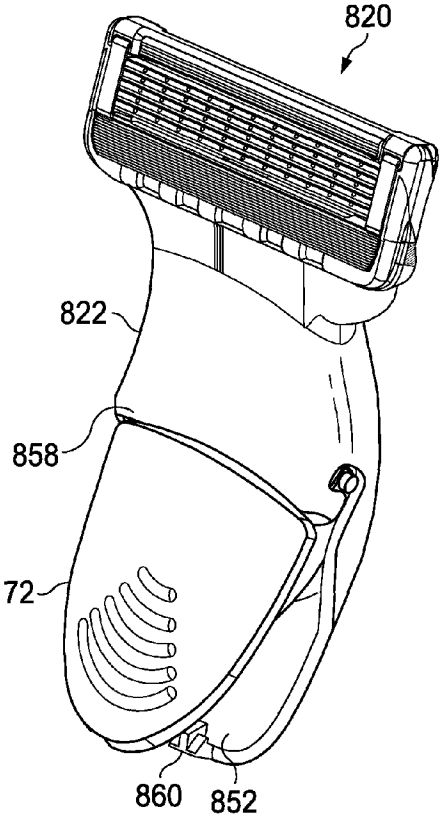

It may be desirable for a consumer to wet shave with the wet shave attachment 820 independent of the trimmer. In a alternate embodiment shown in FIG. 15*a*-15*c*, a grip insert 72 is provided that can be assembled in the connecting member 822. The grip insert 72 insert adds weight to the wet shaving attachment 820 to improve control and maneuverability of the attachment and includes grip features the combination of which improves the ergonomics of the device. FIGS. 16*a* to 16*b* illustrate the progression of assembling the grip insert 72 in the connecting member 422 of the wet shaving attachment 820.

Figure 17A:
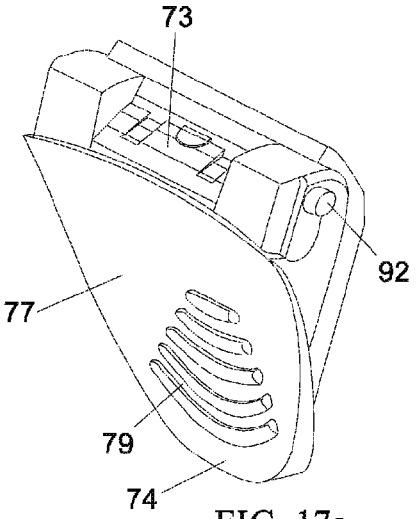
FIG. 17*a* is a perspective view of the grip insert according to the present invention.
Figure 17B:
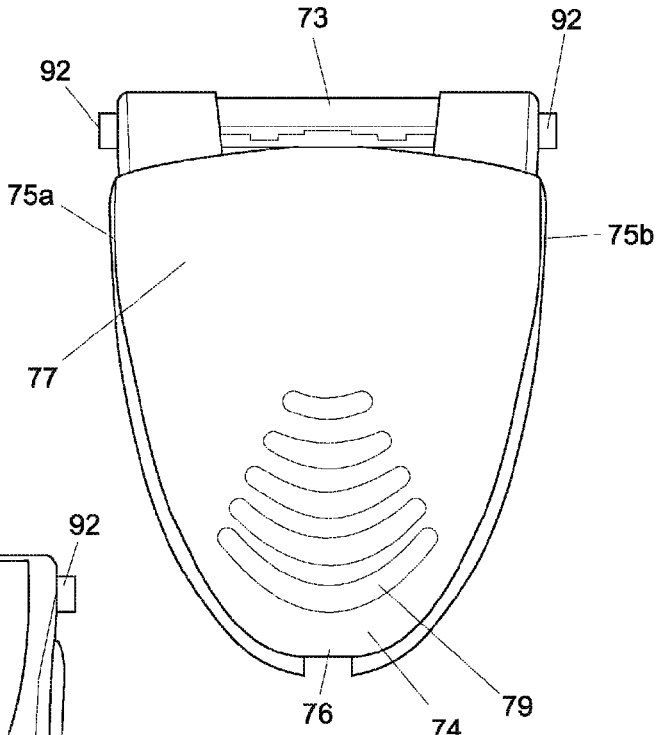
FIG. 17*b* is a top view of the grip insert according to the present invention.
Figure 17C:
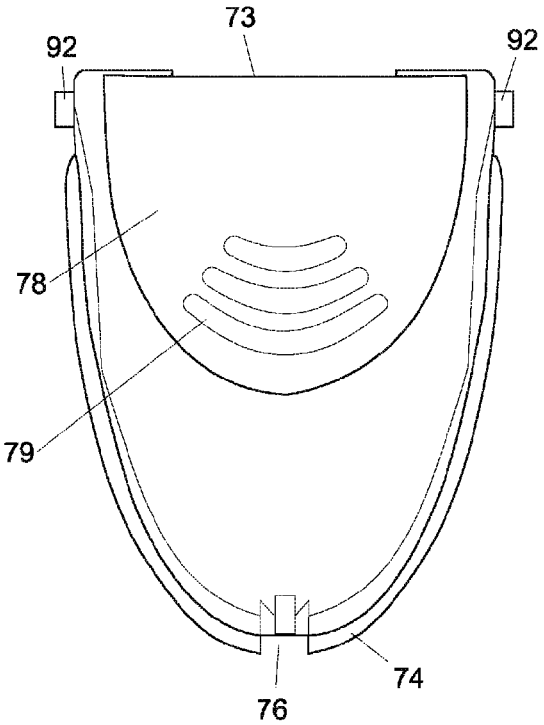
FIG. 17*c* is a bottom view of the grip insert according to the present invention.

The grip insert 72 illustrated in FIGS. 17*a* to 17*c* includes a forward end 73, an aft end 74, and opposing sides 75*a* and 75*b* therebetween. A slot 76 is disposed in the aft end 74 of the insert for releasably attaching to the at least one hook 860 disposed in the aft end 852 of the connecting member 822. The slot can include a channel for interfacing with a rib on the hook of the connecting member. The rib/channel interface limits movement of the insert during use. The forward end 73 of the grip insert 72 is contoured for releasably attaching to the overhanging shoulder 858 of the connecting member 822. Alignment guides comprising alignment members 92 can be disposed at the forward end 73 of the insert on opposing sides 75*a* and 75*b* to interface with alignment grooves 882 on the connecting member 822. As shown in FIGS. 17*a*-17*c*, the alignment members 92 can include pins extending from the grip insert 72. The alignment grooves 882 in the connecting member 822 can include slots in opposing sides of the connecting member 822.

The grip insert 72 can made from a plastic or rubber material having resiliency to facilitate gripping during use. The resiliency of the grip insert 72 also provides a biased connection between the hook 860 in the aft end 852 of the connecting member 822 and the slot 76 in the aft end 74 of the grip insert 72. In addition, top and bottom surfaces 77, 78 of the grip insert 72 include grooves or undulations 79 to reduce slippage, particularly when wet.

Figure 18A:
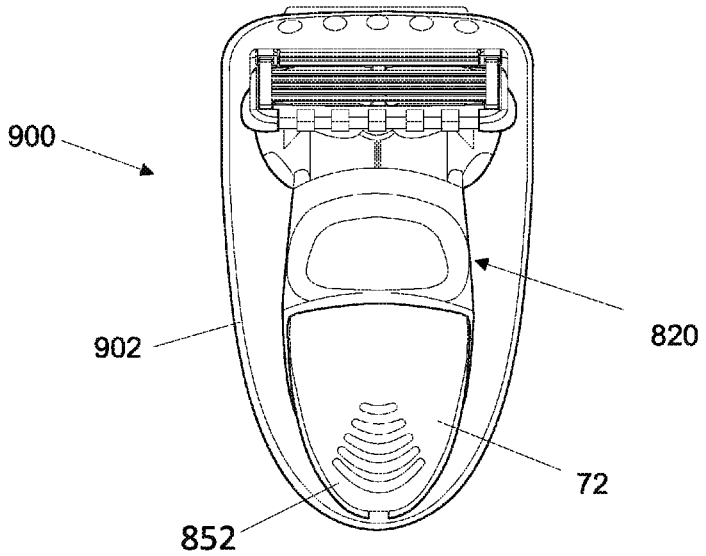
FIG. 18*a* is a top view of the first portion of the case for storing the wet shaving razor attachment including the grip insert.
Figure 18B:
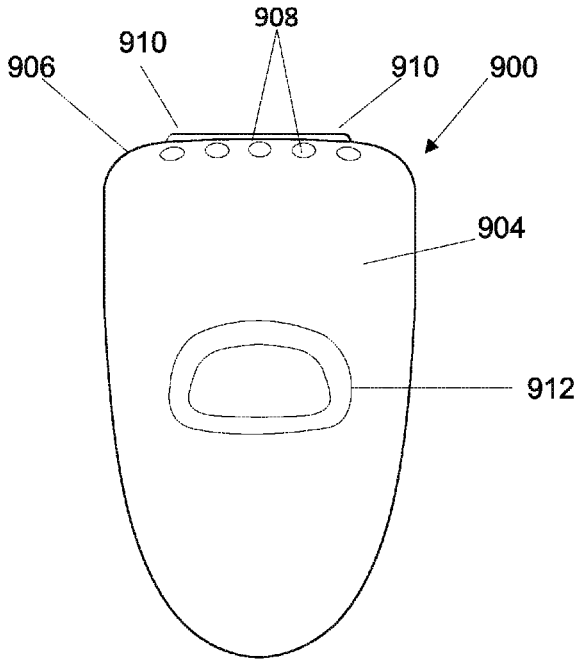
FIG. 18*b* is a top view of the case for storing the wet shaving razor attachment showing the second portion of the case hingedly attached to the first portion of the case shown in FIG. 18*a*.
Figure 19:
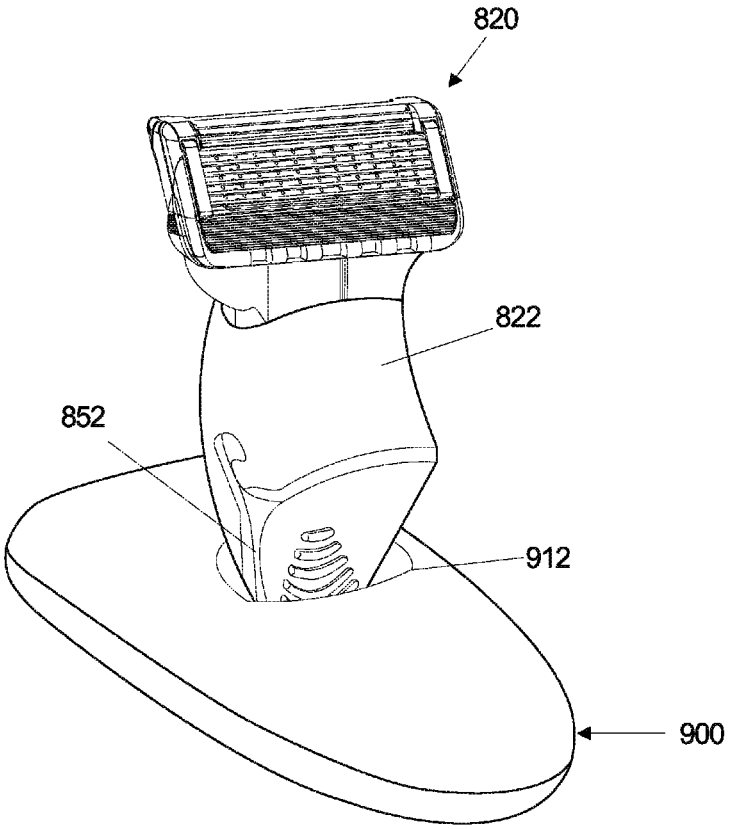
FIG. 19 is a perspective view of the case illustrated in FIG. 18*b* showing the wet shaving razor attachment stowed in the aperture provided in the second portion of the case.

The grip insert 72 may be included as an accessory in the packaging for the combination wet shaving and trimming device. Alternatively, the wet shaving razor attachment 820 and grip insert 72 may be provided in a wet shaving razor kit including a case 900 for storing the wet shaving razor 820. The wet shaving razor case 900 shown in FIGS. 18*a* and 18*b* includes a first portion 902 dimensioned to receive the wet shaving razor 820 and a second portion 904 hingedly attached to the first portion 902 and dimensioned to cover the first portion 902 and the wet shaving razor 820 disposed therein. A first end 906 of the case includes hinges 910 connecting the first portion 902 to the second portion 904 and a plurality apertures 908 disposed in the second portion 904 for drainage and to facilitate drying of the wet shaving razor 820. In addition, the second portion 904 includes a slot 912 in the center of the second portion 904. As shown in FIG. 19. The slot 912 is configured to receive the aft end 852 of the connecting member 822 providing a stand for stowing the wet shaving razor 820 vertically during non use.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet-shaving razor comprising:

a connecting member having a proximal end, a distal end, opposing sides therebetween, the connecting member comprising an overhanging shoulder disposed proximate the proximal end, and at least one hook disposed at the distal end;

a grip insert, made of a rubber or plastic material, said grip insert having a proximal end, a distal end, and opposing sides therebetween, the grip insert comprising a slot disposed in the distal end, wherein the at least one hook disposed at the aft end of the connecting member, releasably attaches to the slot, and the proximal end of the grip insert releasably attaches to the overhanging shoulder of the connecting member, wherein said grip insert encloses a portion of the distal end of the connecting member; and a razor cartridge attached to the proximal end of the connecting member.

2. The wet shaving razor of claim 1 wherein the connecting member further comprises alignment grooves disposed on the opposing sides of the connecting member proximate the proximate end, and wherein the grip insert further comprises alignment members disposed on the opposing sides, proximate the proximate end, wherein the alignment members disposed on the opposing sides of the grip insert releasably attach to the alignment grooves disposed on the opposing sides of the connecting member.

3. The wet shaving razor of claim 2 wherein the alignment grooves are L-shaped and configured to interface with the alignment members and provide one way attachment of the connecting member to the grip insert.

4. The wet shaving razor of claim 1 wherein the razor cartridge is removably attached to the forward end of the connecting member.

5. The wet shaving razor of claim 1 wherein the grip insert is plastic having resiliency to facilitate gripping during use.

6. A wet shaving razor kit comprising:

a wet-shaving razor comprising:

a connecting member having a forward end, an aft end, and opposing sides therebetween comprising a front face and a back face forming a receiving region, the connecting member comprising an overhanging shoulder disposed proximate the forward end, and at least one hook disposed at the aft end;

a grip insert having a forward end, an aft end, and opposing sides therebetween, the grip insert comprising a slot disposed in the aft end, wherein the at least one hook disposed at the aft end of the connecting member, releasably attaches to the slot, and the forward end of the grip insert releasably attaches to the overhanging shoulder of the connecting member, wherein said grip insert fits completely within the boundaries formed by said opposing sides of said connecting member; and a razor cartridge attached to the forward end of the connecting member; and an enclosable case having a first portion dimensioned to receive the wet shaving razor and a second portion hingedly attached to the first portion and dimensioned to cover the first portion and the wet shaving razor disposed therein.

7. The wet shaving razor kit of claim 5 wherein the second portion of the cases includes a slot configured to receive the aft end of the connecting member providing a stand for the wet shaving razor.

8. A wet-shaving razor comprising:

a connecting member having a forward end, and aft end, and opposing sides therebetween, the connecting member comprising an overhanging shoulder disposed proximate the forward end, and at least one hook disposed at the aft end;

a grip insert, made of rubber or plastic material, said grip insert having a forward end, and aft end, and opposing sides therebetween, the grip insert comprising a slot disposed in the aft end, wherein the at least one hook disposed at the aft end of the connecting member, releasably attaches to the slot, and the forward end of the grip insert releasably attaches to the overhanging shoulder of the connecting member, wherein said grip insert fits completely within the boundaries of the connecting member; and a razor cartridge attached to the forward end of the connecting member.

* * * * *